US007401617B2

(12) United States Patent
Göbel

(10) Patent No.: US 7,401,617 B2
(45) Date of Patent: Jul. 22, 2008

(54) UMBRELLA

(75) Inventor: Eberhard Göbel, Ulm (DE)

(73) Assignee: Eberhard Gobel GmbH & Co., Ulm (DE)

( * ) Notice: Subject to any disclaimer, the term of this patent is extended or adjusted under 35 U.S.C. 154(b) by 267 days.

(21) Appl. No.: 11/098,785

(22) Filed: Mar. 30, 2005

(65) Prior Publication Data

US 2005/0217712 A1 Oct. 6, 2005

(30) Foreign Application Priority Data

Mar. 31, 2004 (DE) ..... 20 2004 005 055 U

(51) Int. Cl.
*A45B 25/06* (2006.01)

(52) U.S. Cl. ..... 135/29; 135/28

(58) Field of Classification Search ..... 135/28–30, 135/3.8, 31, 135
See application file for complete search history.

(56) References Cited

U.S. PATENT DOCUMENTS

| | | | | |
|---|---|---|---|---|
| 359,844 | A * | 3/1887 | Cassidy et al. | 135/30 |
| 710,328 | A * | 9/1902 | MacMillan | 135/30 |
| 871,611 | A * | 11/1907 | Nelson | 135/30 |
| 1,266,515 | A * | 5/1918 | Monahan | 135/31 |
| 1,712,430 | A * | 5/1929 | Giszczynski | 135/39 |
| 6,076,540 | A * | 6/2000 | You | 135/22 |
| 7,178,535 | B2 * | 2/2007 | Eder | 135/28 |

FOREIGN PATENT DOCUMENTS

| | | |
|---|---|---|
| AT | 183186 | 2/1955 |
| DE | 1937891 | 8/1970 |
| DE | 203 04 453 | 7/2003 |
| GB | 2165448 | 4/1986 |

* cited by examiner

*Primary Examiner*—David R Dunn
*Assistant Examiner*—Danielle N Jackson
(74) *Attorney, Agent, or Firm*—Andrew Wilford

(57) ABSTRACT

An umbrella has a shaft having upper and lower ends, a slide piece, and a head piece. One of the pieces has an upper part and a lower part having faces that are engaged together and that form a plurality of seats of predetermined diameter spaced angularly about the shaft. The parts are also formed at each seat with a radially outwardly open and axially extending notch of an angular width substantially smaller than the diameter of the respective seat. They are fixed together at the faces. Respective rib or strut elements each have a shaft of a width at most equal to the notch width and a head of a diameter smaller than the seat diameter. The heads are received in the seats and the shafts project outward from the respective seats through the respective notches. A standard canopy is fitted over the ribs outside the head piece.

4 Claims, 3 Drawing Sheets

UMBRELLA

FIELD OF THE INVENTION

The present invention relates to an umbrella. More particularly this invention concerns a standard collapsible umbrella intended mainly for use when it rains.

BACKGROUND OF THE INVENTION

In German utility model 203 04 453 published 24 Jul. 2003 an umbrella is described having a shaft having upper and lower ends and defining an axis, a head piece at the upper end forming a plurality of seats, and ribs fitted to the seats. A canopy fitted over the ribs outside the head piece and struts are engaged between central regions of the ribs and a slider on the shaft for opening and closing the umbrella.

When such an umbrella is exposed to excessive wind, the canopy can invert, that is move from a position where it is concave toward the lower-end handle to a position where it is oppositely concave. When this happens the ribs can pull out of the head piece, ruining the structure and basically making the umbrella unusable. Depending on the construction of the head piece, such inversion can bend the inner ends of the ribs and break or permanently damage them.

OBJECTS OF THE INVENTION

It is therefore an object of the present invention to provide an improved umbrella.

Another object is the provision of such an improved umbrella that overcomes the above-given disadvantages, in particular that can withstand substantial wind forces and, even, inversion of its canopy without damage.

A further object is to provide such an improved umbrella that can be made at low cost.

SUMMARY OF THE INVENTION

An umbrella has according to the invention a shaft having upper and lower ends and defining an axis, a slide piece between the ends, and a head piece at the upper end. One of the pieces has an upper part and a lower part respectively having upper and lower faces that are engaged together and that form a plurality of seats of predetermined diameter spaced angularly about the shaft. The parts are also formed at each seat with a radially outwardly open and axially extending notch of an angular width substantially smaller than the diameter of the respective seat. The parts are fixed together at the faces. Respective ribs or struts each have a shaft of a width at most equal to the notch width and a head of a diameter greater than the seat diameter. The heads are received in the seats and the shafts project outward from the respective seats through the respective notches. A standard canopy is fitted over the ribs outside the head piece.

Thus the ribs and/or the struts are mounted by the large-diameter heads, not by the simple pivot pins provided in the prior art. Thus the system can take quite some abuse, with no permanent deformation of the ribs or head piece.

According to the invention the faces of the two head piece parts are secured together at a weld. To this end the parts are of ultrasonically weldable plastic. This forms an extremely solid, virtually unitary part, so that the inner rib ends with the heads cannot possibly pull out of the head piece. Thus the head piece can be made extremely strong with a very simple manufacturing process that does not run any risk of adhering the plastic of the head piece to the normally metal ribs.

In accordance with the invention the parts are formed at the faces with centering formations. More particularly, the formations include axially extending centering pins projecting from the face of one of the parts and axially open holes in which the pins are snugly engaged formed in the other of the faces. Thus the two parts are fitted together with the pins engaged in the holes, then they are welded together. This again eases assembly and lowers manufacturing costs as the centering formations ensure perfect alignment of the head parts prior to being welded together.

The heads and seats are substantially complementarily spherical. Thus the rib or strut elements will not tend to break if twisted, but instead can pivot in the seats.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
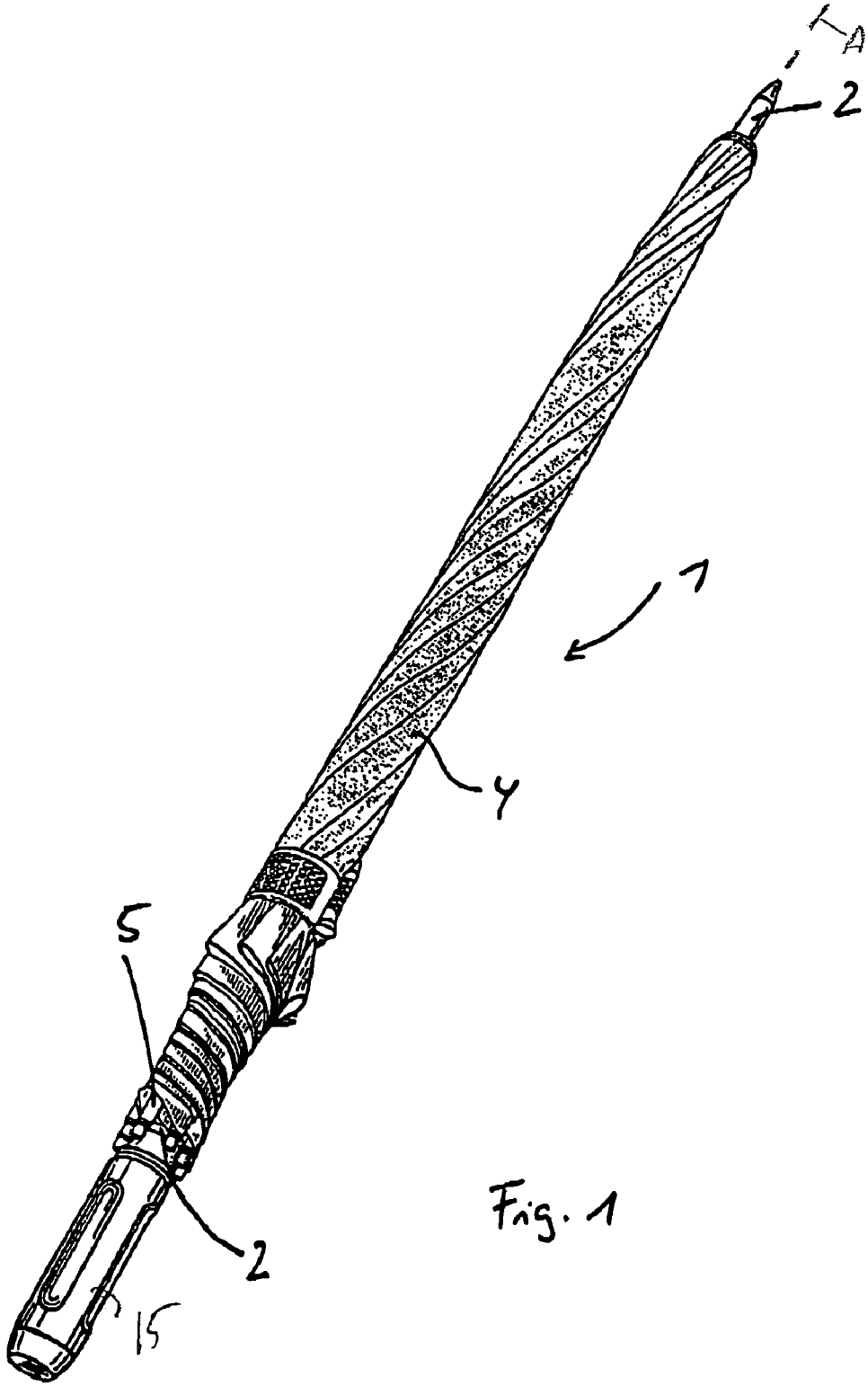
FIGS. 1 and 2 are perspective views of the umbrella according to the invention in closed and open condition.
Figure 2:
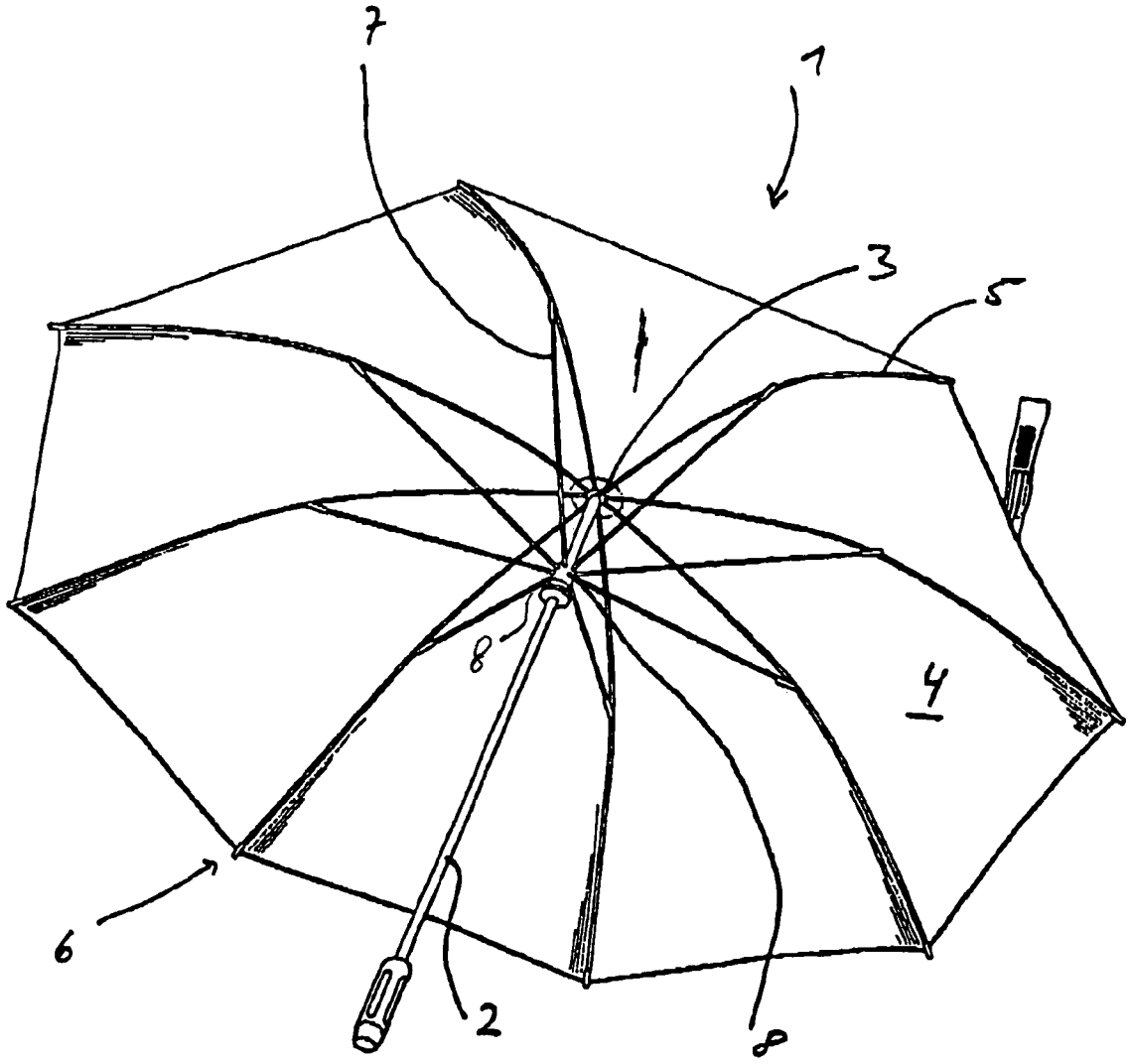

As seen in FIGS. 1 and 2 an umbrella 1 according to the invention basically comprises a shaft 2 defining an axis A, a head piece 3 fixed at its outer or upper end, and a handle 15 fixed at its inner or lower end. A canopy 4 is secured to a frame 6 formed by standard radial ribs 5 each centrally pivoted on a respective strut 7. The upper ends of the ribs 5 are pivoted in the head piece 3 and the lower ends of the struts 7 are pivoted in a slide piece 8 that is shifted along the shaft 2 to move the canopy from the down position of FIG. 1 to the up position of FIG. 2. This is all standard.

Figure 4:
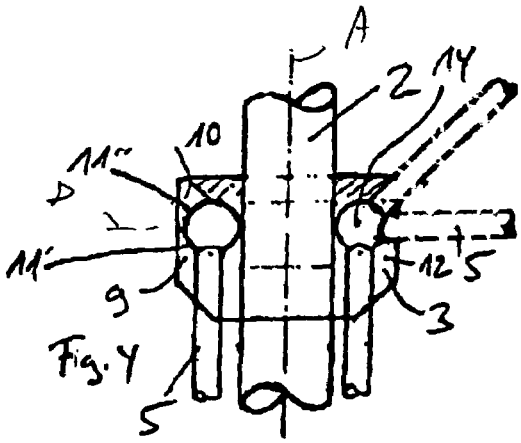
FIG. 4 is a partially sectional side view of the head piece.
Figure 3:
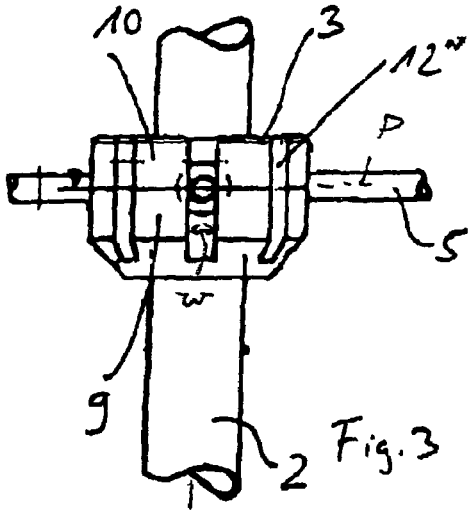
FIG. 3 is a side view of the head piece of the umbrella.
Figure 5:
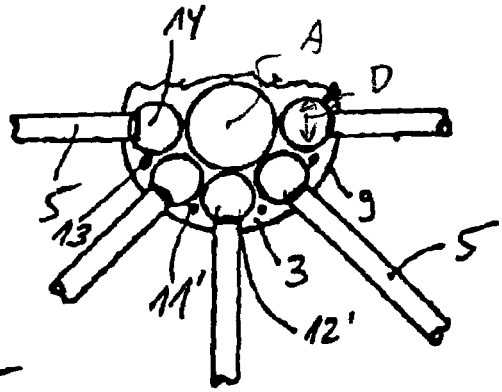
FIG. 5 is a top view of the lower part of the head piece.

In accordance with the invention as shown in FIGS. 3 to 5, the head piece 3 is formed by lower and upper annular parts 9 and 10 that fit together at a plane P perpendicular to the axis A. The lower part 9 is formed with an array of angularly equispaced upwardly open semispherical seats 11', and the upper part 19 is complementarily formed with angularly equispaced and downwardly open seats 11". The lower part 9 is also formed in line with each seat 11' with a radially outwardly open and axially extending groove 12' of a width w substantially smaller than a diameter D of the respective seat 11'. Similarly the upper part 10 is formed at each seat 11" with a radially outwardly open and axially extending groove 12' of the same width w.

The inner ends of the ribs 5, which are metal tubes or profiles, are formed with ball heads 14 of a diameter slightly less than the diameter D and are received in the seats 11' and 11". Thus the ribs 5 can pivot between a down end position extending parallel to the axis A toward the handle 15 and shown in FIG. 4 in solid lines, to the partially erected position extending in the plane P and shown in FIG. 4 dashed lines, to an up end position extending at an angle of about 45° to the axis A and away from the handle 15.

The part 9 is formed with axially projecting pins 13 (FIG. 5 only) that fit extend across the plane P into complementary holes in the part 10 to hold the parts 9 and 10 together during manufacture. Once assembled, the two parts 9 and 10 are ultrasonically welded or otherwise permanently adhered together at their abutting faces at the plane P.

It is also within the scope of the invention to form the slider piece 8 in the same manner as the head piece 3, and to form the lower ends of the struts 7 with ball heads like the ribs 5.

I claim:

1. An umbrella comprising:

a shaft having upper and lower ends and defining an axis;

a head piece at the upper end;

a slide piece between the upper and lower ends, one of the pieces having an upper part and a lower part made of ultrasonically weldable plastic and respectively having generally planar upper and lower faces that are engaged together and that are each formed with an array of axially open generally semispherical seat halves, the seat halves of the upper part forming with the seat halves of the lower part a plurality of seats of predetermined diameter spaced angularly about the shaft, the parts being formed at each seat with a radially outwardly open and axially extending notch of an angular width substantially smaller than the diameter of the respective seat, the face of one of the parts being formed with axially extending centering pins and the face of the other of the parts being formed with axially open holes receiving the pins;

an ultrasonic weld fixing the parts together at the faces;

a frame having a set of rib elements with inner ends engaged in the head piece and a set of strut elements having inner ends engaged in the slide piece and outer ends engaged with the rib elements, the elements of the set engaged in the one piece each having a shaft of a width at most equal to the notch width and a head of a diameter smaller than the seat diameter, the heads being received in the seats and the shafts projecting outward from the respective seats through the respective notches; and a canopy fitted over the ribs elements outside the head piece.

2. The umbrella defined in claim 1 wherein the heads and seats are substantially complementarily spherical.

3. The umbrella defined in claim 1 wherein each of the parts is generally cylindrical and coaxial with the shaft.

4. The umbrella defined in claim 3 wherein the faces of the parts are generally perpendicular to the axis, the seats being generally semispherical and open axially.

* * * * *